US006982619B2

(12) United States Patent
Nussio

(10) Patent No.: US 6,982,619 B2
(45) Date of Patent: Jan. 3, 2006

(54) SOLENOID STATOR ASSEMBLY HAVING A REINFORCEMENT STRUCTURE

(75) Inventor: Randy Nussio, Grand Rapids, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/361,124

(22) Filed: Feb. 7, 2003

(65) Prior Publication Data

US 2004/0155740 A1 Aug. 12, 2004

(51) Int. Cl.
*H01F 7/08* (2006.01)

(52) U.S. Cl. ..... 335/262; 336/90; 336/198

(58) Field of Classification Search ..... 336/90, 336/92, 96, 115, 117–118, 192, 198; 335/262; 310/12–39

See application file for complete search history.

(56) References Cited

U.S. PATENT DOCUMENTS

| | | | | |
|---|---|---|---|---|
| 4,219,154 A | | 8/1980 | Luscomb | |
| 4,360,161 A | | 11/1982 | Claxton et al. | |
| 4,407,245 A | | 10/1983 | Eheim | |
| 4,467,231 A | | 8/1984 | Biglino | |
| 4,538,084 A | | 8/1985 | Kawada et al. | |
| 4,568,021 A | * | 2/1986 | Deckard et al. | 239/88 |
| 4,618,095 A | | 10/1986 | Spoolstra | |
| D286,768 S | | 11/1986 | Borsh et al. | |
| 5,006,748 A | | 4/1991 | Wintermute | |
| 5,155,461 A | | 10/1992 | Teerman et al. | |
| 5,339,063 A | | 8/1994 | Pham | |
| 5,749,717 A | | 5/1998 | Straub et al. | |
| 5,782,411 A | | 7/1998 | Potter | |
| 5,914,548 A | | 6/1999 | Watanabe et al. | |
| 5,926,082 A | * | 7/1999 | Coleman et al. | 335/260 |
| 5,949,163 A | | 9/1999 | Karafillis et al. | |
| 5,954,487 A | * | 9/1999 | Straub et al. | 417/505 |
| 6,019,091 A | | 2/2000 | Spoolstra | |
| 6,019,344 A | | 2/2000 | Engel et al. | |
| 6,035,979 A | * | 3/2000 | Forster | 188/266.6 |
| 6,036,460 A | | 3/2000 | Christ et al. | |
| 6,053,421 A | | 4/2000 | Chockley | |
| 6,089,470 A | | 7/2000 | Teerman et al. | |
| 6,091,173 A | | 7/2000 | Byrd | |
| 6,138,643 A | * | 10/2000 | Oguchi et al. | 123/495 |
| 6,158,419 A | | 12/2000 | Jett et al. | |
| 6,175,168 B1 | * | 1/2001 | Budd et al. | 310/12 |

FOREIGN PATENT DOCUMENTS

JP 04-48604 2/1992

* cited by examiner

*Primary Examiner*—Lincoln Donovan
*Assistant Examiner*—Bernard Rojas
(74) *Attorney, Agent, or Firm*—Brooks Kushman P.C.

(57) ABSTRACT

A solenoid stator assembly and manufacturing method for an electro-mechanically actuated fuel injector. The solenoid stator assembly comprises a permeable stator core and a stator coil. A housing formed of an electrically insulating material is located about the stator core and stator coil such that a distal end of the stator core is oriented proximate to an armature of the fuel injector. A pair of terminals extends into the housing to a pair of leads for the stator coil to energize the stator coil and generate a magnetic field for actuating the fuel injector armature. A reinforcement structure is disposed generally about the stator core within the housing to improve the robustness of the stator assembly.

14 Claims, 6 Drawing Sheets

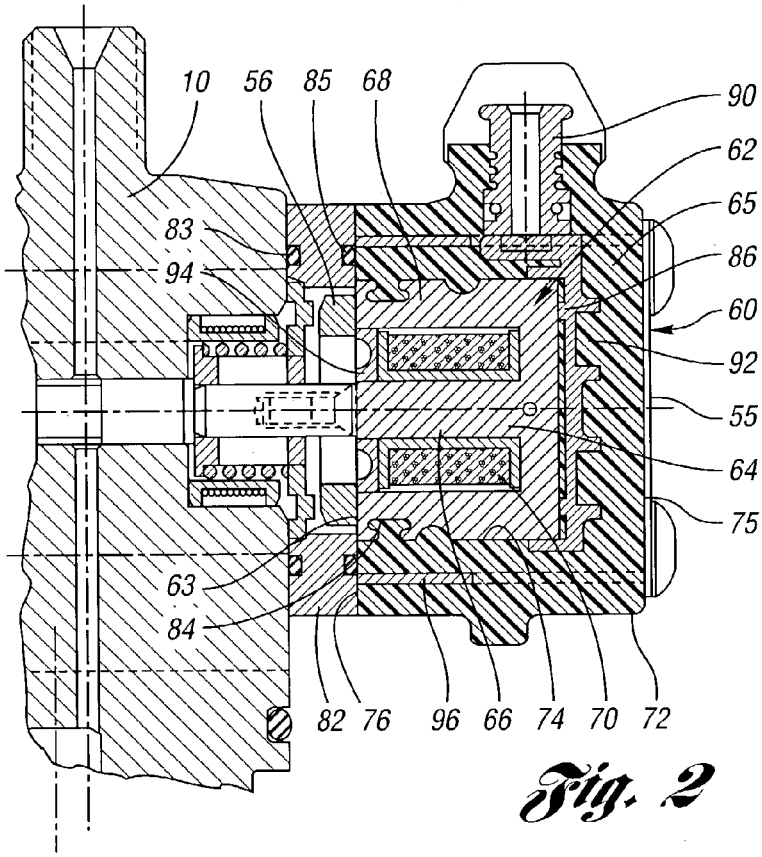
Fig. 2
Fig. 2a
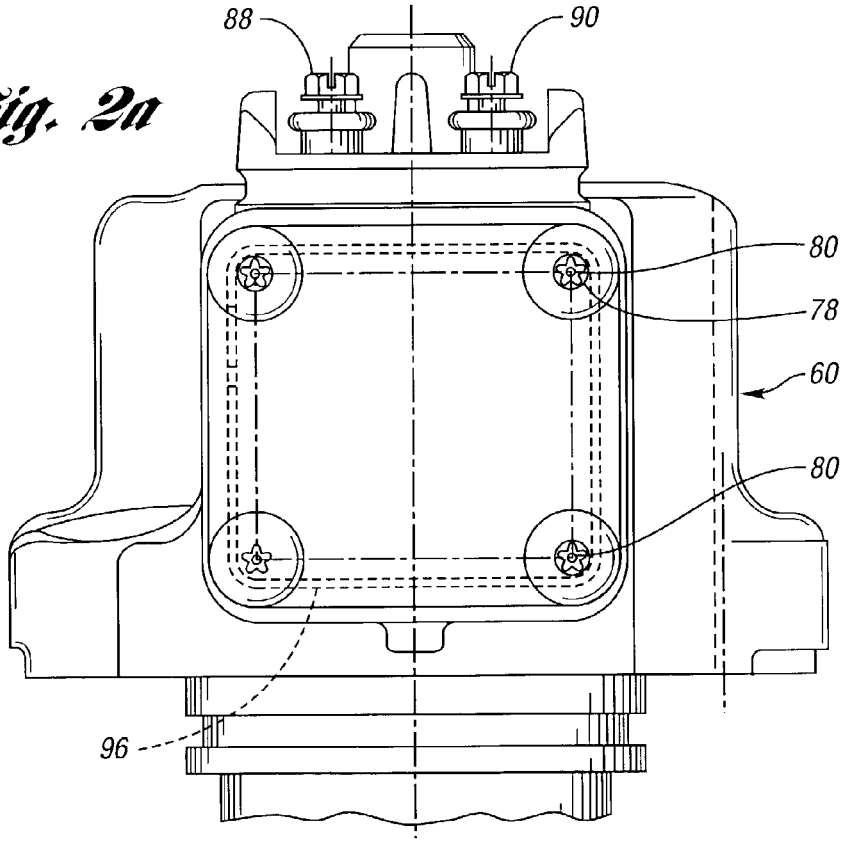

Fig. 5b
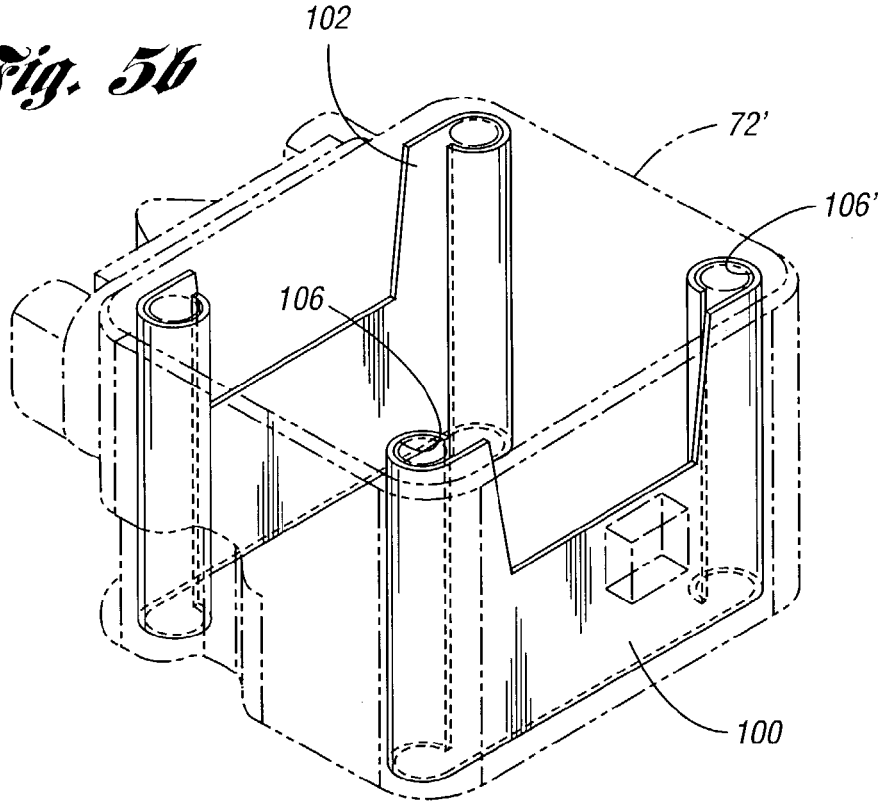
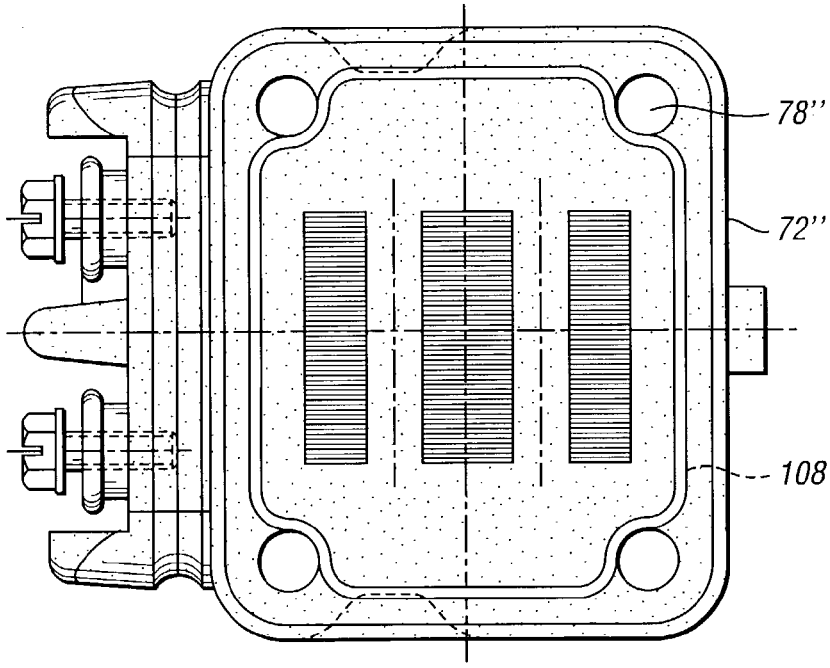
Fig. 6

SOLENOID STATOR ASSEMBLY HAVING A REINFORCEMENT STRUCTURE

BACKGROUND OF THE INVENTION

1. Field of the Invention

The invention relates to a solenoid stator assembly for an electromechanically actuated fuel injector and, more particularly, to a solenoid stator assembly with a reinforcement structure.

2. Background Art

Conventional solenoid stator assemblies for electromechanically actuated fuel injectors include a stator core with a stator coil for developing a magnetic force upon an armature of a fuel injector. The armature is typically part of a valve assembly for regulating the flow of fuel to an injector nozzle. The solenoid stator assembly commonly includes a housing formed of an electrically insulating material for enclosing the stator core and the stator coil. Electrical terminals, which extend into the housing, are connected to an input lead and an output lead for the stator coil.

Electrical current under the control of an electronic engine controller is distributed to the stator coil for controlling injection timing and fuel metering by the valve assembly. Fuel passing through the valve assembly during a fuel injection pulse is pressurized at a high injection nozzle pressure. Fuel passing through the valve assembly between injection pulses, which is referred to as spill fuel flow, is substantially lower than nozzle injection pressure. The stator assembly, particularly the stator housing, is in contact with the lower pressure spill flow, but the spill flow pressure still is sufficiently high to cause undesirable pressure loading. The pressurized fuel may seep between the core and the housing, thus pressurizing and deforming the housing. Continued pressure applied to the stator assembly may cause the housing to fatigue, fracture, or separate from the core.

Since the solenoid stator assembly is used in fuel injectors for motor vehicles, it may experience also large changes in temperature. Due to differing rates of thermal expansion of the materials used in injectors, the solenoid stator assembly may experience thermal loading, which may exacerbate separation of the housing from the stator core. Further, the solenoid stator assembly may undergo cavitation erosion caused by fluid dynamics associated with the reciprocating armature.

Prior art solenoid stator assemblies have attempted to overcome these difficulties with various degrees of success. For example, U.S. Pat. No. 5,155,461, which is assigned to assignee of the present invention, discloses a preloaded solenoid stator assembly to overcome the loads encountered during use. The '461 patent also discloses a stator core having a plurality of external configurations for bonding with an over-molded polymer housing.

Attempts have been made using other prior art solenoid stator assemblies to improve robustness by providing an external housing or band, typically metallic, about an insulated housing. An example of a design of this type is disclosed in U.S. Pat. No. 5,339,063 issued to Pham. Another prior art reference, U.S. Pat. No. 5,926,082, issued to Coleman et al., discloses a reinforcement band disposed about the lower end of a stator housing.

Although the prior art references disclose various solenoid stator assemblies that are structurally enhanced to overcome mechanical and hydraulic loads, they generally are costly due to complex manufacturing processes required and the special materials needed.

SUMMARY OF THE INVENTION

The present invention comprises a solenoid stator assembly for a control valve actuator assembly of an electromechanically actuated fuel injector characterized by enhanced robustness. The assembly includes a permeable stator core having a central pole piece and an outer pole piece, each terminating at a pole face. A stator coil is wound about the central pole piece for developing a magnetic flux flow path. A housing formed of an electrically insulating material, such as a moldable polymer, encloses the stator core and stator coil such that the pole face is oriented proximate to an armature with a calibrated air gap therebetween. A reinforcement structure disposed within the housing is oriented generally about the stator core for structurally enhancing the housing. A pair of electrical terminals extends through the housing for completing an electrical circuit through the stator coil.

The present invention further comprises a method for forming a robust, structurally-enhanced solenoid stator assembly described above. The method includes the step of orienting a stator coil about a central pole piece for a stator core. Then the stator core and a reinforcement structure are inserted into a mold, the reinforcement structure being spaced from the stator core throughout the stator core periphery. An electrically insulating material, such as a moldable polymer, then is injected between the reinforcement structure and the stator core using an injection molding technique, thereby forming a housing about the stator core that encapsulates the reinforcement structure.

The reinforcement structure supports compression loads of attachment bolts that secure the actuator assembly of which the stator assembly is a part to an injector body. The design of the stator assembly further provides stiffness in a radial direction as well as in the direction of the axis of the armature.

By encapsulating the reinforcement structure with a molded polymer, there is no need to use a pressing operation for assembling the reinforcement structure in place. Press fits that would be required in such a pressing operation would require close dimensional control to avoid stress failure due to mechanical forces associated with press fitting.

During manufacture, the stator core face is finish-ground in a post-encapsulation step. The presence of the encapsulating polymer will allow any burrs developed during grinding to be flushed away by coolant fluid. There is not a cavity surrounding the core where burrs can accumulate.

The stator, which is defined by steel laminations, does not need to be contoured to reduce fuel seepage or to secure the polymer encapsulation to the stator. Because of this, there is no reduction in magnetic force on the armature for a given actuating current, and injector response is improved.

The single, one-piece reinforcement structure has a further manufacturing advantage because it can be formed from a flat steel workpiece using a series of punching and forming steps. The seam that is created then can be welded or crimped.

BRIEF DESCRIPTION OF THE DRAWINGS

FIG. 2 is an enlarged cross-sectional view of the stator assembly of the injector of FIG. 1;

FIG. 2*a* is a side elevation of the stator assembly of FIG. 2, seen from the right side of the stator assembly of FIG. 2;

FIG. 5*b* is an isometric assembly view of reinforcement elements of the alternate embodiment of FIG. 5; and FIG. 6 is a plan view of another alternate embodiment of a reinforcement structure embodying features of the invention.

DETAILED DESCRIPTION OF THE PREFERRED EMBODIMENTS

Figure 1:
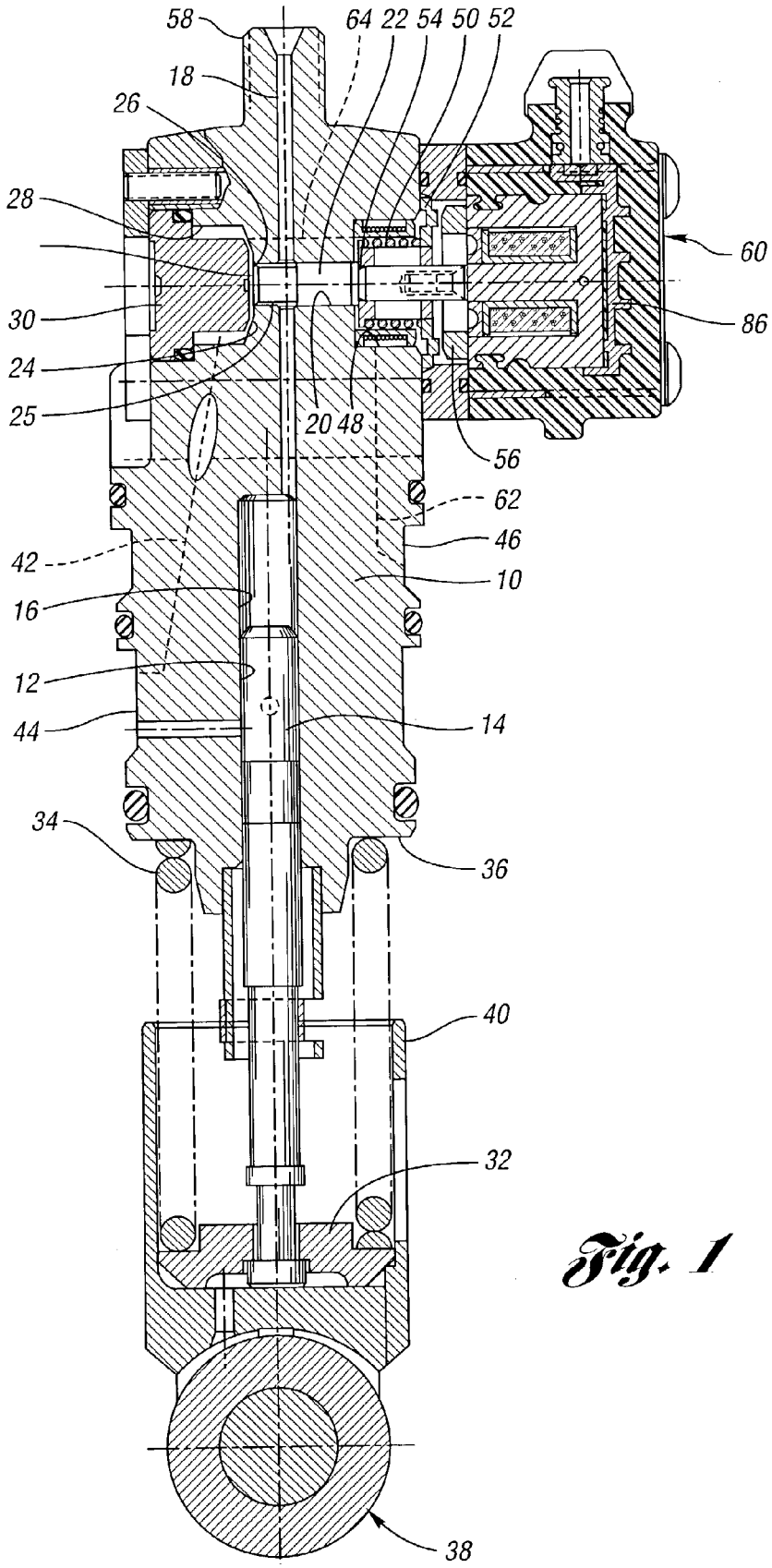
FIG. 1 is a partial sectional view of a fuel injector that includes the solenoid stator assembly of the present invention.

FIG. 1 shows a unit pump for a fuel injector assembly. It comprises a pump body 10, which is formed with a central cavity or bore 12 in which a piston plunger 14 is situated. The plunger 14 and the bore 12 define a high-pressure pumping chamber 16, which is in communication with a high-pressure fuel delivery passage 18.

A control valve chamber 20 is formed in the upper portion of the body 10. It intersects the high-pressure fuel delivery passage 18 as shown. A control valve element 22 is positioned in the valve chamber 20. A valve seat 24 formed in the pump body at the left end of the valve opening 20 is engaged by a valve land on the end of valve element 22, as shown at 26.

A valve stop opening 28 receives a valve stop 30 situated in close proximity to the valve land 26. When the valve element 22 is shifted in a left-hand direction, the valve land 26 becomes unseated, thereby establishing communication between valve stop chamber 28 and passage 18 through the valve space defined by annular valve opening 25 surrounding the valve element 22. When the valve element 22 is shifted in the right-hand direction to close the valve land 26 against the valve seat 24, a high injection pressure is developed in passage 18 as the plunger 14 is driven into the pumping chamber 16.

Plunger 14 is connected to a spring shoulder element 32, which engages plunger spring 34. Spring 34 is seated on spring body seat 36 on the pump body 10.

The plunger 14 and the spring seat element 32 are driven with a pumping stroke by engine camshaft-operated cam follower assembly 38. A spring sleeve 40, surrounding spring 34, is carried by the follower assembly 38.

A low-pressure spill passage 42 communicates with the valve stop space 28 and returns fuel from passage 18 to a flow return port in communication with annular groove 44 in the pump body 10. A fuel supply groove 46, which is connected to a fuel supply pump, communicates with a valve spring chamber 48. A valve spring 50 in the valve spring chamber 48 is seated on spring seat 52 and is engageable with a spring shoulder 54 carried by valve element 22. The spring 50 normally urges the valve element 22 to an open position, the limit of the valve travel being determined by valve stop 30. The spacing between valve element 22 and the stop 30 is shown at 29.

The valve element 22 is connected to an armature 56, which forms a part of the actuator assembly. This will be described in detail with reference to FIGS. 2–4. The injector assembly includes a fluid fitting 58, which is connected to a fuel injection nozzle (not shown).

Figure 1A:
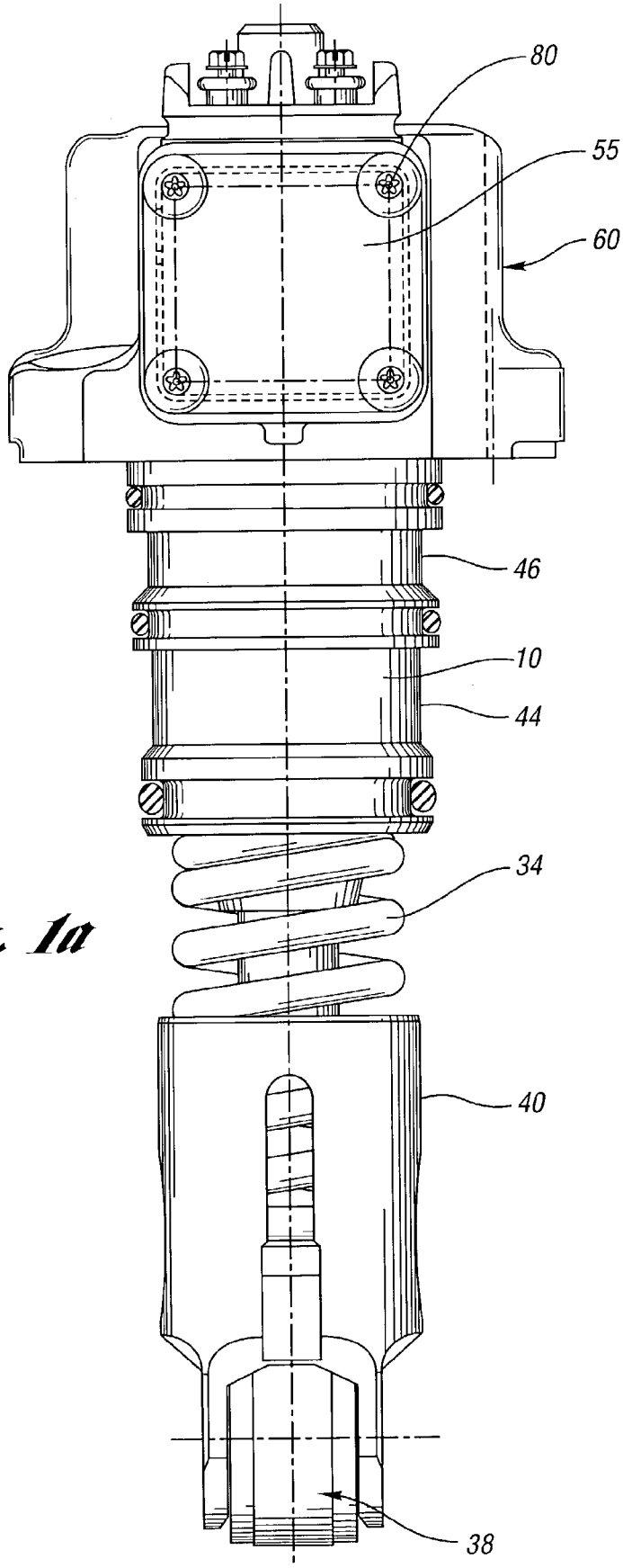
FIG. 1*a* is a side elevation view of the injector of FIG. 1.

Reference may be made to U.S. Pat. No. 6,276,610, issued to Gregg R. Spoolstra, for an understanding of the mode of operation of the valve and valve actuator for developing a fuel injection pressure pulse in passage 18. The actuator assembly is generally designated in FIGS. 1–4, as well as in FIG. 1*a*, by reference numeral 60.

Fuel is supplied to spring chamber 48 through passage 62, which in turn communicates with the valve stop chamber 28 through crossover passage 64. The spring chamber communicates also with the valve stop chamber 28 through an internal passage (not shown) formed in the valve element 22.

Figure 3:
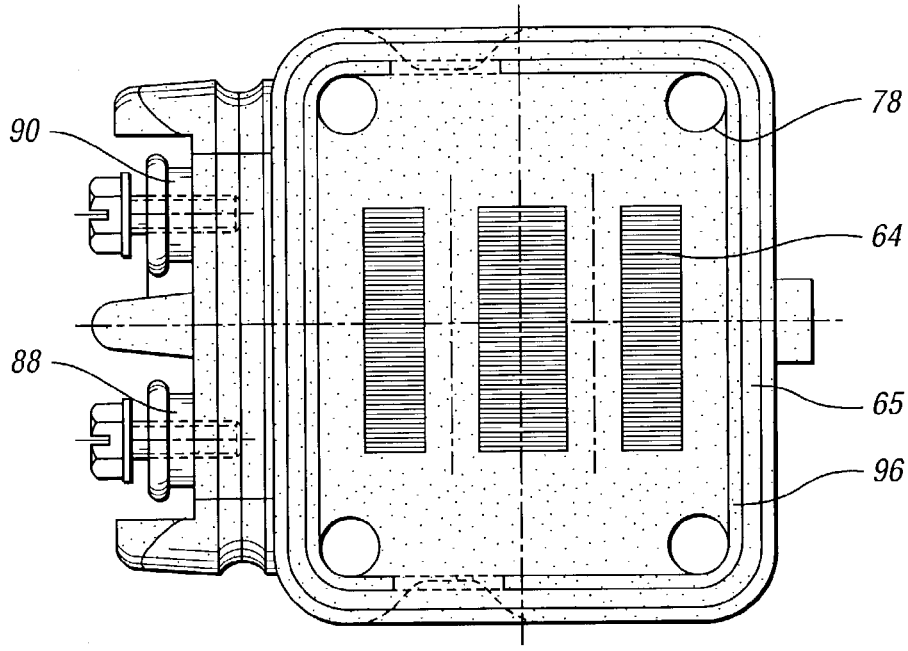
FIG. 3 is a side elevation view of the stator core and housing of FIG. 2, seen from the left side of the stator assembly of FIG. 2, with parts shown by phantom lines.

As seen in FIGS. 2, 2*a* and 3, the actuator assembly 60 includes a solenoid stator assembly 62 and the previously described armature 56. The solenoid stator assembly includes a stator core 64, which is comprised of laminations of permeable magnetic material, such as carbon steel. The laminations can be seen best in the end view of FIG. 3. The cross-section of the stator core, when viewed in FIG. 2, has a generally E-shaped profile with a central pole piece 66 sorrounded by outer pole piece 68. Each of these pole pieces terminates at a pole face oriented proximate to mounting end 63 of the solenoid stator assembly 62. The outer pole piece 68 and the central pole piece 66 are integrally formed in the embodiment illustrated. However, the outer pole piece 68 may be formed instead by a flux guide that is separate from the central pole piece 66.

A stator coil 70 is oriented about the stator core central pole piece 66. The stator coil 70 comprises conductor windings wound about a bobbin or spool positioned about central pole piece 66. The windings of the stator coil 70 are insulated in known fashion to prevent a short circuit between individual windings and between the windings and the stator core 64.

The stator coil 70 includes a pair of leads, not shown, for connecting it to a power source. The solenoid stator assembly 62 may include a pair of electrical terminals 88 and 90 extending from the assembly. Each of the terminals 88 and 90 is connected to one of the pair of leads emerging from the stator coil 70. As the current flows through the stator coil 70, a magnetic field is generated, providing a flux flow pattern at the central pole piece 66. Selective control of current through the stator coil 70 provides timed actuation of the armature 56.

The solenoid stator assembly 62 includes a housing 65 formed of an electrically insulating material, preferably a polymer, for enclosing the stator core 64 and stator coil 70. The housing 65 is generally cup shaped with a closed end 75 and an open end at a mounting surface 76 of the solenoid stator assembly 62, as seen in FIG. 2. The housing 65 has an outer wall 72 and an internal cavity 74 enclosing the stator core 64 and stator coil 70 such that the distal end of the stator core central pole piece 66 is oriented proximate to the mounting surface 76 of the housing 65. The mounting surface 76 is formed about the periphery of the wall 72 and is attachable to the fuel injector body 10 for sealed engagement therewith. Accordingly, the housing 65 includes a hole pattern 78, as best illustrated in FIGS. 2*a* and 3. The hole pattern 78 includes a plurality of apertures for receiving fasteners, such as bolts 80, for attaching the solenoid stator assembly 62 to the fuel injector body 10, as illustrated in FIG. 1. A spacer 82, of the same general shape as the shape of housing 65, is interposed between body 10 and surface 76. O-ring seals 83 and 85 prevent leakage. The housing 65 encloses the inner components of the solenoid stator assembly 62. FIG. 3 is an end view of the stator assembly 62 with the inner components shown in phantom, including the laminations of stator core 64.

The housing 65 is preferably formed by an injection molding process. Injection molding is a cost effective method for forming the housing 65 and for encapsulating the stator core 64. Further, the injection molding process securely bonds the housing 65 to the stator core 64. In order to improve bonding engagement between the stator core 64 and the housing 65, the stator core 64 may include a plurality of external attachment slots 84 for mechanically interlocking the housing 65 to the external surfaces of the stator core 64. This mechanical interlock enhances the attachment and helps prevent pressurized fuel from seeping between the core and the housing.

The solenoid stator assembly 62 further includes an insulator cap 86 for supporting the terminals 88 and 90 outside of the housing 65. The leads for coil 70 are electrically connected to terminals 88 and 90, preferably by soldering. The cap 86 is formed of a suitable electrically insulating material and rests atop the stator assembly 62 for properly orienting the terminals 88 and 90, as shown, during the molding process. The insulator cap 86 also includes grooves 92 for mechanically retaining in place wire leads for stator coil 20 during the encapsulating step. The wire leads are routed through grooves 92 as they are extended to terminals 88 and 90.

The coil 70 further includes a rigid, insulating seal 94 for preventing pressurized fuel from seeping within the stator core 62 about the stator coil 70. The seal 94 may be integral with the spool or bobbin of which coil 70 is a part. The seal 94 may be integral also with the housing 65 and may be formed during the injection molding process of the housing 65.

The solenoid stator assembly 62 includes an elongate reinforcement structure 96 disposed within the housing 65. The reinforcement structure 96 is oriented generally about the stator core 64 for structurally enhancing the housing 65. The reinforcement structure 96 has a length generally equal to that of the housing 65.

Figure 4:
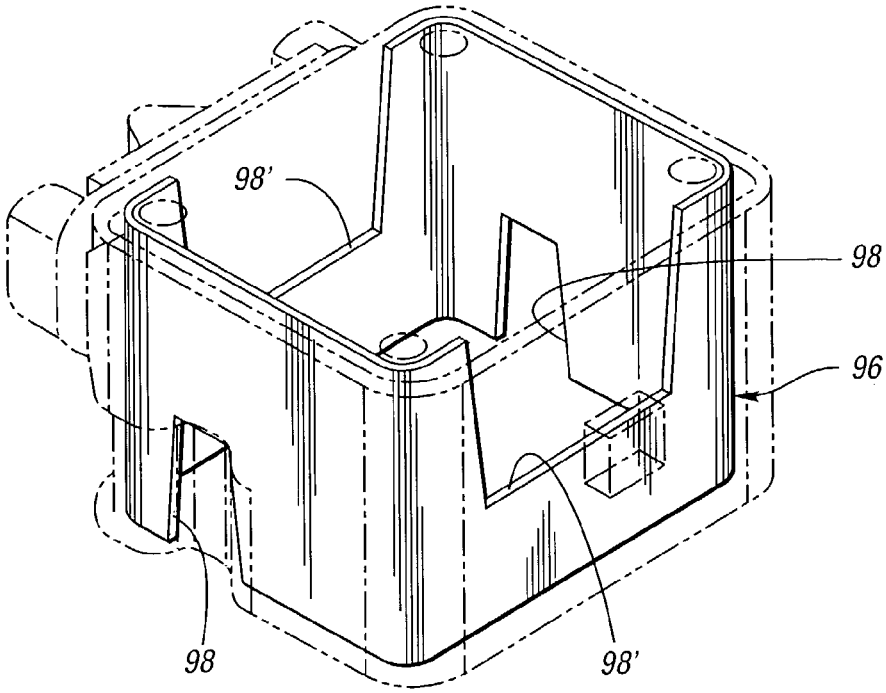
FIG. 4 is a perspective view of a first embodiment of a reinforcement structure.

One embodiment of the reinforcement structure 96 is best illustrated in FIGS. 3 and 4. It is generally rectangular and may be formed from a band of stamped sheet steel manufactured in a progressive die stamping operation. Accordingly, the band would be crimped or welded together to form the continuous tubular design. Alternatively, the tubular profile of the reinforcement structure 96 could be cut from an elongate tubular piece of steel, thus eliminating the crimping or welding operation.

The reinforcement structure 96 is preferably formed from low carbon steel for structurally enhancing the housing 65. It supports compressive loads applied by the plurality of fasteners 80 that mount the actuator assembly 60 to the fuel injector body 10, as illustrated in FIG. 1. A reinforcing plate 55, seen in FIG. 2, can be positioned on the outer side of closed end 75, the fasteners 80 extending through fastener openings in plate 55. Plate 55 can be used also as a name plate if that is desired.

The reinforcement structure 96 also enhances the housing 65 by providing support for internal pressure loading applied by pressurized fuel in the fuel injector body 10. Accordingly, the reinforcement structure 96 may experience hoop stress about its periphery. It may be oriented relative to the hole pattern 78 for enclosing the pressure loaded regions of the housing 65. The reinforcement structure 96 is oriented within the wall 72 for preventing radial deformation of the insulating material of the housing 65, thereby preventing fatigue failure.

Preferably, the reinforcement structure 96 is molded within the housing 65, as is the stator core 64 and stator coil 70. These components are inserted into a mold and then the polymer material forming the housing 65 is injection molded thereabout. To enhance the engagement of the housing 65 and the reinforcement structure 96, the reinforcement structure may include a plurality of configurations, such as cutouts 98 and 98', seen in FIG. 4, for mechanically interlocking the electrically insulating material of the housing 65 with the reinforcement structure 96. One of the cutouts 98' is used to provide clearance for the terminals 88 and 90, which extend from the housing 65. The reinforced housing 65 is effective for supporting compressive loads as well as hydraulic pressure loading.

The simplified solenoid stator assembly 62 eliminates several manufacturing steps needed in the manufacture of prior art designs, such as press fitting an external sleeve about the housing. Additionally, machining of the mounting surface 76 does not require a deburring operation because the reinforcement structure 96 is disposed within the wall 72. The distal ends of the central pole piece 66 and the outer pole piece 68 are not covered by insulating material, which enhances the magnetic force and consequently the injector response.

Figure 5:
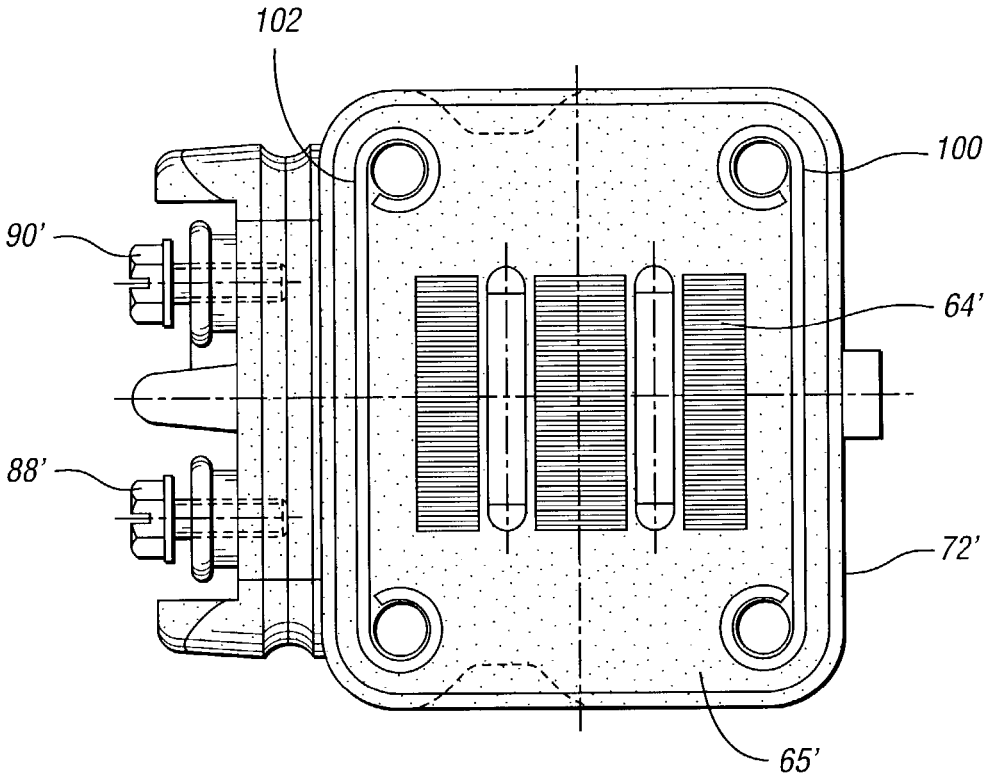
FIG. 5 is a view similar to FIG. 3, with parts shown by phantom lines, of an alternate embodiment of the invention.
Figure 5A:
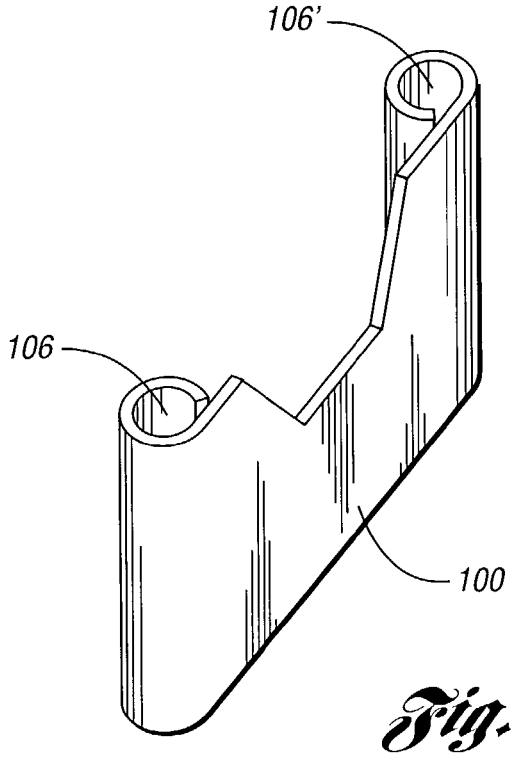
FIG. 5*a* is a detail isometric view of a reinforcement element of the alternate embodiment of the invention shown in FIG. 5.

FIGS. 5 and 5*a* show an alternative embodiment of a solenoid stator assembly in accordance with the present invention. Similar elements shown in these figures retain same reference numerals with prime notations, but new elements are assigned new reference numerals. The solenoid stator assembly 62' includes a distinct pair of reinforcement elements 100 and 102, which are oriented about the stator core 62' and positioned within the wall 72' of the housing 65'. Although the reinforcement structure provided by reinforcement members 100 and 102 reduces material costs, it is not as resistant to hydraulic pressure loading as a continuous design, as in the embodiment of FIGS. 1–4. Accordingly, the reinforcement elements 100 and 102 may be ideal in applications having lower pressure loading, thus reducing the cost of the solenoid stator assembly. Reinforcement elements 100 and 102 have rounded end openings 106 and 106', which receive clamping bolts.

FIG. 6 shows another alternative embodiment of a reinforcement structure for a solenoid stator assembly. The reinforcement structure of FIG. 6 is generally of square, tubular shape, as shown at 108, and is disposed within the wall 72" of the housing. Unlike the prior embodiments, the entire perimeter of the reinforcement structure 108 is oriented within the hole pattern 78". This alternative design directs compressive loads applied in a region proximate to each individual fastener aperture in a direction that is opposite to that of the hydraulic pressure loading. Accordingly, this alternative design structurally enhances in an alternate fashion the structural integrity of the solenoid stator assembly.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A solenoid stator assembly for an electromechanically actuated fuel injector, the solenoid stator assembly comprising:

a permeable stator core having a central pole piece and an outer pole piece, each pole piece terminating at a pole face;

a stator coil with a central axis comprising conductor windings about the stator core central pole piece, the stator coil being insulated with respect to the stator core and having a pair of leads;

a housing formed of an electrically insulating material, the housing having a wall with a mounting end and a closed end, the wall defining an internal cavity for enclosing the stator core and stator coil therein such that the pole face of the stator core central pole piece is oriented proximate to the mounting end of the housing, which forms a mounting surface about the periphery of the wall, the stator assembly being attachable to a fuel injector such that the mounting surface sealingly engages a corresponding fuel injector surface, the pole face of the stator core central pole piece being proximate to an armature of the fuel injector;

the insulating material engaging an outer surface of the stator core whereby the stator core is secured firmly to the housing;

an elongate reinforcement structure disposed within the insulating material of the housing whereby the reinforcement structure is enveloped by the insulating material, the reinforcement structure being positioned generally about the stator core for structurally enhancing the housing;

the reinforcement structure extending in the direction of the central axis and from the mounting end of the housing to the closed end of the housing; and a pair of electrical terminals extending into the housing, each terminal being connected to one of the pair of leads of the stator coil for conducting an electrical current therethrough to generate a flux field that electro-mechanically actuates the fuel injector armature.

2. The solenoid stator assembly of claim 1, wherein the outer pole piece of the stator core is spaced apart from and about the central pole piece.

3. The solenoid stator assembly of claim 1, wherein the housing is formed by injection molding.

4. The solenoid stator assembly of claim 1, wherein the reinforcement structure is generally tubular.

5. The solenoid stator assembly of claim 1, wherein the reinforcement structure is formed from stamped sheet steel.

6. The solenoid stator assembly of claim 1, wherein the reinforcement structure is defined by a pair of distinct reinforcement members.

7. The solenoid stator assembly of claim 1, wherein the reinforcement structure provides clearance for the terminals to extend from the housing.

8. The solenoid stator assembly of claim 1, wherein the reinforcement structure undergoes compressive loads applied at the closed end of the housing by a plurality of fasteners to mount the housing on the fuel injector, the insulating material having openings extending in the direction of the central axis for receiving the fasteners.

9. The solenoid stator assembly of claim 1, wherein the reinforcement structure is molded into the housing, the insulating material having openings extending in the direction of the central axis for receiving fasteners whereby the reinforcement structure undergoes compressive loads applied to the reinforcement structure at the closed end of the housing.

10. The solenoid stator assembly of claim 1, wherein the housing includes a hole pattern for mounting the housing to the fuel injector, the reinforcement structure being oriented at least in part about the hole pattern.

11. The solenoid stator assembly of claim 1, wherein the housing is formed about and within the reinforcement structure.

12. The solenoid stator assembly of claim 11, wherein the reinforcement structure includes recesses for mechanically interlocking the electrically insulting material of the housing disposed outside the reinforcement structure with the electrically insulating material of the housing disposed within the reinforcement structure.

13. A method for forming a structurally enhanced solenoid stator assembly for a fuel injector, the method comprising:

orienting a stator coil about a central pole of a stator core;

inserting the stator core and a reinforcement structure into a mold, such that the reinforcement structure is oriented about the stator core and extends throughout the axial extent of the assembly; and injection molding an electrically insulating material to form a housing about the stator core and reinforcement structure, resulting in a robust solenoid stator assembly capable of accommodating clamping loads imposed on the housing when the stator assembly is mounted on the fuel injector.

14. A solenoid stator assembly for an electro-mechanically actuated fuel injector, the solenoid stator assembly comprising:

a permeable stator core having a central pole piece and an outer pole piece, each pole piece terminating at a pole face;

a stator coil formed of windings about the stator core central pole piece and having a pair of leads;

a cup shaped housing formed of an electrically insulating material, the housing having a generally tubular wall with an open end and a closed end, the tubular wall defining an internal cavity for enclosing the stator core and stator coil therein such that the pole face of the stator core central pole piece is oriented proximate to the open end of the housing, the other end of the housing forming a mounting surface about the periphery of the generally tubular wall, the open end being attachable to a fuel injector such that the mounting surface sealingly engages a corresponding fuel injector surface, the pole face of the stator core central pole piece being proximate to an armature of the fuel injector;

the insulating material engaging an outer surface of the stator core whereby the stator core is secured firmly to the housing;

a reinforcement structure disposed within the tubular wall of the housing, the reinforcement structure being oriented generally about the stator core for undergoing compressive loading applied to the reinforcement structure at the closed end of the housing by fasteners for mounting the housing to the fuel injector, and for accommodating internal pressure loading from pressurized fuel in the fuel injector;

the reinforcement structure extending in the direction of the central axis and from the open end of the housing to the closed end of the housing; and a pair of electrical terminals extending into the housing, each terminal being connected to one of the pair of leads of the stator coil for conducting an electrical current therethrough, which generates a flux field to electro-mechanically actuate the fuel injector armature.

* * * * *